US006349141B1

(12) United States Patent
Corsaro

(10) Patent No.: US 6,349,141 B1
(45) Date of Patent: Feb. 19, 2002

(54) DUAL BI-LAMINATE POLYMER AUDIO TRANSDUCER

(75) Inventor: Robert D. Corsaro, Waldorf, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/684,978

(22) Filed: Oct. 10, 2000

Related U.S. Application Data

(60) Provisional application No. 60/187,944, filed on Mar. 3, 2000.

(51) Int. Cl.[7] ..... H04R 25/00

(52) U.S. Cl. ..... 381/190; 381/423; 381/431; 310/311

(58) Field of Search ..... 381/150, 152, 381/174, 173, 190, 191, 423, 426, 431; 310/311, 324, 353

(56) References Cited

U.S. PATENT DOCUMENTS 5,115,472 A * 5/1992 Park et al. ..... 381/152

* cited by examiner

*Primary Examiner*—Curtis Kuntz
*Assistant Examiner*—Suhan Ni
(74) *Attorney, Agent, or Firm*—John J. Karasek; L. George Legg

(57) ABSTRACT

Various embodiments of low-mass sound generators each having a wide frequency band are disclosed. In some embodiments, the acoustic transducer acting as the sound generator is constructed of four layers of PVDF film. The top and bottom bi-laminate members are separately formed in a pre-curved manner to form a rippled geometry.

9 Claims, 8 Drawing Sheets

DUAL BI-LAMINATE POLYMER AUDIO TRANSDUCER

This application claims priority to provisional application No. 60/187,944 filed Mar. 3, 2000.

BACKGROUND OF THE INVENTION 1.0 Field of the Invention

The present invention relates to loudspeaker sometimes referred to as sound generators. More particularly, the present invention relates to a very low-mass, light-weight sound generator with a wide frequency bandwidth principally used in large surface area applications, such as wall covers, where mass is of crucial importance and when so used in such an arrangement is capable of delivering high sound levels required for audio generation or active sound control.

2.0 Description of the Related Art

A very wide variety of sound generators exist, the most familiar being the common loudspeaker. This and other such sound generators perform well in many applications, but all have disadvantages, which limit their range of applicability.

For example, conventional loudspeakers use high-mass voice coils. In aerospace applications where weight is a crucial expense, the use of loudspeakers can become prohibitive. Horn and buzzer type actuators can be designed which are light-weight and capable of low frequency use, however, their narrow-Land nature and poor controllability limits their use to a narrow range of applications.

Polymer speakers have been successful in high frequency applications. These typically are electrostatic or piezoelectric (i.e. using poly-vinylidene fluoride film, abbreviated as PVDF). However, existing technologies are not capable of delivering the high displacement levels required for reproducing mid or low frequency audible sounds.

Aside from their use in sound generation, polymeric materials have been used in a bi-laminate configuration to generate motion. More particularly, when a voltage is applied to PVDF film (or any piezoelectric material) it changes thickness and length according to well-known constitutive piezoelectric equations. The thickness change is typically very small, but the length change can be significant. This elongation can be amplified by constructing a bi-laminar pair, often called a "bimorph," which may be further described with reference to FIG. 1 showing a prior art parallel-laminate configuration 10.

FIG. 1 shows two layers 12 and 14 of PVDF film which are glued together with their polarities in the same direction in a manner known in the art. The voltage, $\Delta V$, to each PVDF film is applied between the center electrode (CE) (at the laminate interface) and the outer electrode (OE) of each laminate in a manner known in the art. FIG. 1 further illustrates each laminate as having an elongate length $L_a$, and a possible displacement y, whereas the combined thickness of the laminates, along with their associated electrodes is given by t.

The displacement $\Delta y$ and force F generating ability of thin laminate (and most simple actuators) is given by the usual expression.

$$\Delta y = \left(1 - \frac{F}{F_b}\right)\Delta y_0 \tag{1}$$

This equation contains two commonly measured parameters: the no-load tip displacement $\Delta y_0$ and blocked-force $F_b$, defined as follows:

$$\Delta y_0 = \frac{3}{4}\left(\frac{L_a}{t}\right)^2 d_{31}\Delta V \tag{2}$$

$$F_b = \frac{3}{2}t\left(\frac{W}{L_a}\right)Y d_{31}\Delta V \tag{3}$$

With regard to expressions (2) and (3), t is the film thickness (of one layer, such as 12, of the bi-laminate made up of layers 12 and 14), $L_a$ is the unconstrained length, W is the width of the parallel-laminate configuration 10, and $\Delta V$ is the applied voltage. The parameters Y and $d_{31}$ are respectively the Young's modulus and the piezoelectric charge constant, both in the direction of length (the so-called "31" direction of the polymer). If multiple layer pairs, such as multiple pairs of layers 12 and 14, are used (in fully-bonded arrangements) the force increases by the square of the number of pairs.

Another common implementation is the series-laminate configuration (not shown), in which the polarities of the voltage potentials applied to the two layers, such as layers 12 and 14, are reversed and the positive voltage thereof is applied only across the outer two electrodes. This construction of the series-laminate configuration is simpler to fabricate (since it does not have a center electrode), but disadvantageously produces only half the deflection per applied volt.

The above bi-laminates, such as the parallel-laminate configuration 10 and the series-laminate configuration (not shown), is shown (e.g., FIG. 1) in the cantilever configuration, where one end is clamped and the other is free for movement thereof. An alternative configuration is called the "beam" configuration, known in the art, in which both ends of the associated layers, such as layers 12 and 14, are clamped and the center of the associated layers is free to displace vertically.

An additional common configuration uses only one active layer, with the other layer being inactive. As used herein, an "active" layer is meant to represent that the layer experiences movement and that the layer is comprised of an electro-acoustic material, such as a PVDF film. This one active layer arrangement is often called a "monomorph." It has reduced performance, but is of a lower cost.

The above bi-laminates have been previously used primarily as actuators for motion control. They have also found some use as sound generators in resonant (narrow bandwidth) alarm applications (typically using hard ceramic piezoelectric material) or for very low-level high-frequency novelty music sources. However, the prior art bi-laminate configurations have not used as broad-band sound generators. Therefore, a need exists in the prior art for bi-laminates that serve as broad-band sound generators.

SUMMARY OF THE INVENTION

An object of the present invention is to provide for bi-laminate configurations each having the ability to generate associated displacements so as to reproduce high sound levels required for audio generation or active sound control.

A further object of the present invention is to provide for various bi-laminates configurations, each of which serves as broad-band sound generators.

Another object of the present invention is to provide for bi-laminates that may be arranged into different configurations to provide for relatively large arrays all of which serve as broad-band sound generators.

Objects and advantages of the present invention are achieved by a bi-laminated members providing for an acoustic transducer. The acoustic transducer comprises a pair of bi-laminate members each having distal opposite ends. At least one layer of each of the pair of bi-laminate members being of an active electro-acoustic material. Each pair of bi-laminate members has inner and outer surfaces with a first electrode affixed to each outer surface of each pair of bi-laminate members and with a second electrode affixed to each inner surface of each pair of bi-laminate members. Each of the pair of the bi-laminate members extends along an elongated length and each of the pairs is affixed to one another at their respective distal opposite ends along the length. At least one of each of the pair of bi-laminate members has a curved central portion along the elongated length disposed between the distal opposite ends. The curved central portion of the bi-laminate member is displaced from its respective bi-laminate member in a direction transverse to the elongated length and effective so as to permit vibration of the bi-laminate members with respect to one another.

BRIEF DESCRIPTION OF THE DRAWINGS

These and other objects and advantages of the invention will become apparent and more readily appreciated for the following description of the preferred embodiments, taken in conjunction with the accompanying drawings of which.

DESCRIPTION OF THE PREFERRED EMBODIMENTS

Reference will now be made in detail to the preferred embodiments of the present invention, examples of which are illustrated in the accompanying drawings, wherein like reference numbers referred to like elements throughout. One embodiment of the present invention may be described with reference to FIG. 2.

Figure 1:
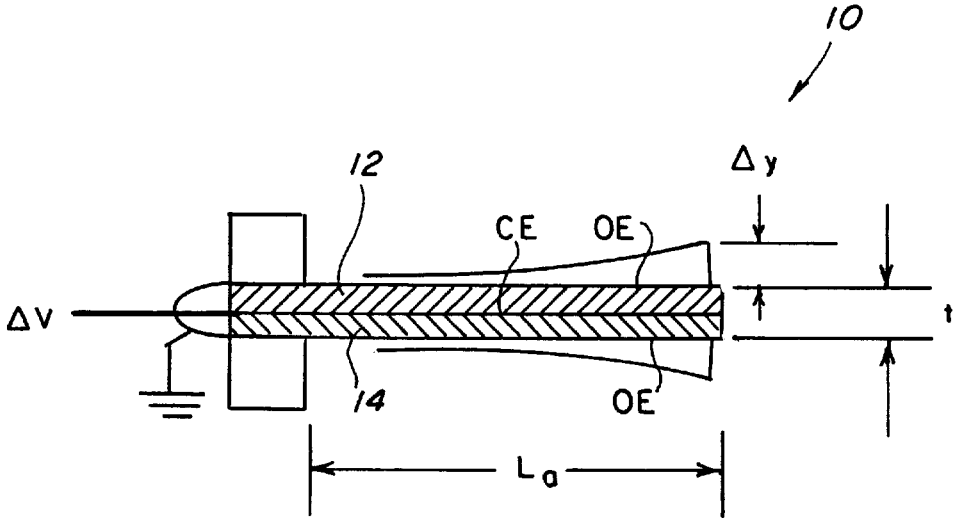
PRIOR ART FIG. 1
FIG. 1 is a prior art bi-laminate configuration used in motion control.
Figure 2:
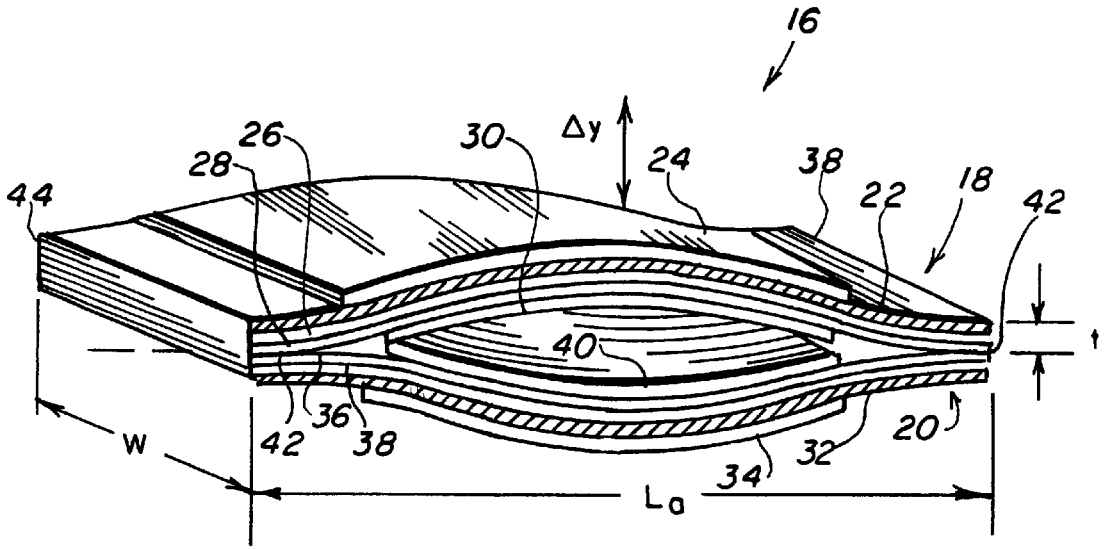
FIG. 2 is a schematic of a dual bi-laminate element of the present invention.

FIG. 2 illustrates a acoustic transducer 16 having the parameters of elongated length $L_a$, displacement $\Delta y$, a thickness parameter, t, that were already shown in the prior art arrangement of FIG. 1, and that were all previously described with reference to expressions (1), (2), and (3). However, the thickness dimension, t, of the acoustic transducer 16 is associated with each of the pairs of bi-laminated members 18 and 20. More particularly, the pair 18 of bi-laminated members has a thickness, t, and the pair 20 of bi-laminated members also has a thickness t. Further, each pair 18 and 20 of hi-laminated member has a width, W, as shown in FIG. 2.

The bi-laminated pair 18 comprises at least one layer 22 formed of an active electro-acoustic material, an electrode 24 fixed to a major portion of the outer surface of the layer 22, an electrode 26 fixed to the inner surface of layer 22, a layer 28 preferably formed of an active electro-acoustic material, and an electrode 30 fixed to a major portion of the inner surface of layer 28.

The second bi-laminated pair 20 comprises elements 32, 34, 36, 38, and 40 that are respectively the same as elements 22, 24, 26, 28, and 30 of the first bi-laminated pair 18. The bi-laminated pairs 18 and 22 are preferably fixed to one another at their distal opposite ends by means of a suitable adhesive 42 and are only attached to each other at their edges 44. Further details of the acoustic transducer 16 may be further described with reference to FIG. 3.

Figure 3:
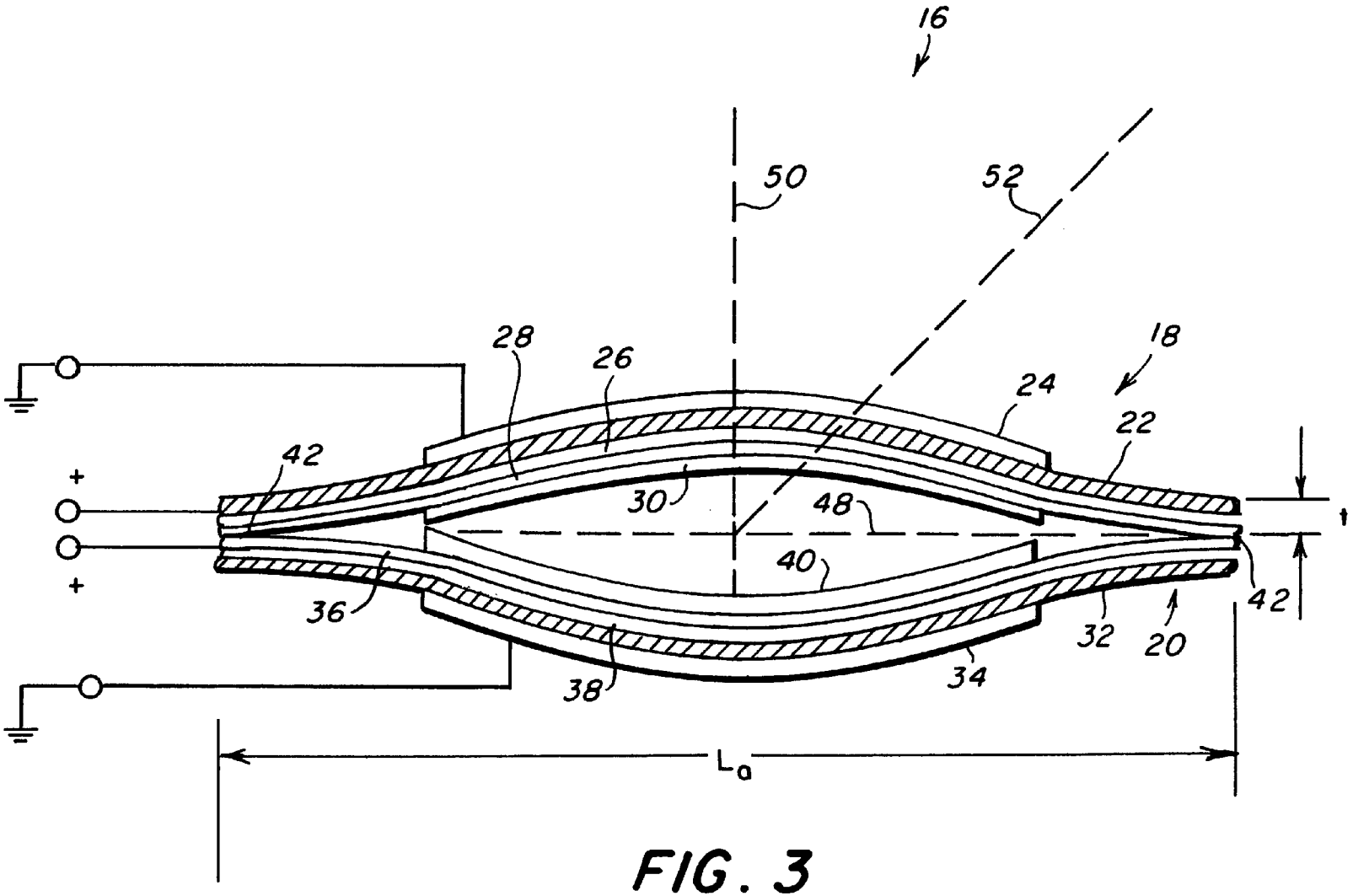
FIG. 3 is a enlarged front view of the dual bi-laminate element of FIG. 2.

FIG. 3 illustrates the acoustic transducer 16 as having dimension lines 48, 50, and 52 which correspond to the x,y, and z axes thereof, with the x axes 48 being parallel to the elongated length $L_a$ and the z axes 52 being in a direction transverse to the elongated length $L_a$. The acoustic transducer 16 is arranged so as to be effective to permit vibration of the bi-laminate pairs 18 and 20 with respect to one another.

FIG. 3 further illustrates that the electrode 24 of the bi-laminate pair 18 and the electrode 34 of the bi-laminate pair 20 both being connected to a ground potential. Further, FIG. 3 illustrates that the electrode 26 of the bi-laminate pair 18 and the electrode 38 of the bi-laminate pair 20 being connected to a positive voltage potential.

Each of the bi-laminate pairs 18 and 20 extends along the elongated length $L_a$ and each has a curved, such as a convex central portion, as shown in FIG. 2 and 3, along the elongated length $L_a$. The curved central portion is disposed between the distal opposite ends located at edges 44. The convex central portion of each of the bi-laminate pairs 18 and 20 is displaceable from one another along the transverse direction 52.

The electrodes 24, 30, 34 and 40 are typically of silver ink, and are preferably disposed as much as possible within the confines of the central portion of the convex bi-laminate pairs 12 and 20. More Particularly it is preferred that the electrodes, in particular, electrodes 30 and 40 not contact the adhesive 42.

The acoustic transducer 16, shown in FIGS. 2 and 3, and sometimes referred to herein as a bi-laminate bender, provides relatively high displacement $\Delta y$ values previously discussed with reference to equations (1)–(3). The acoustic transducer 16 is essentially four layers, that is, elements 22, 28, 32 and 36, comprised of an active material (such as PVDF film) and configured as a dual bi-laminate bender.

The top and bottom layers 22 and 32, respectively, are poled in one direction while the center two layers 28 and 36 are oppositely poled. The top and bottom layered pairs 18 and 20 are glued together by a suitable adhesive while the layers are arranged on a pre-curved form defining the convex central portion of the pairs 18 and 20. The bi-laminate pairs 18 and 20 are then attached to each other only at the two edges 44 shown in FIG. 2.

In operation, when a voltage is applied to the electrodes 24, 30, 34, and 40, the bending of these bi-laminate pairs 18 and 20 will generate a net thickness change of magnitude Δy shown in FIG. 2. It should be noted that the Δy quantity is only shown in FIG. 2 for the bi-laminated pair 18, but an equal quantity Δy is also applicable for bi-laminated pair 20, but is not shown. The total element thickness for the transducer 16 change can be more effectively used to generate sound by the addition of at least one cover plate or sheet, which may be further described with reference to FIG. 4.

Figure 4:
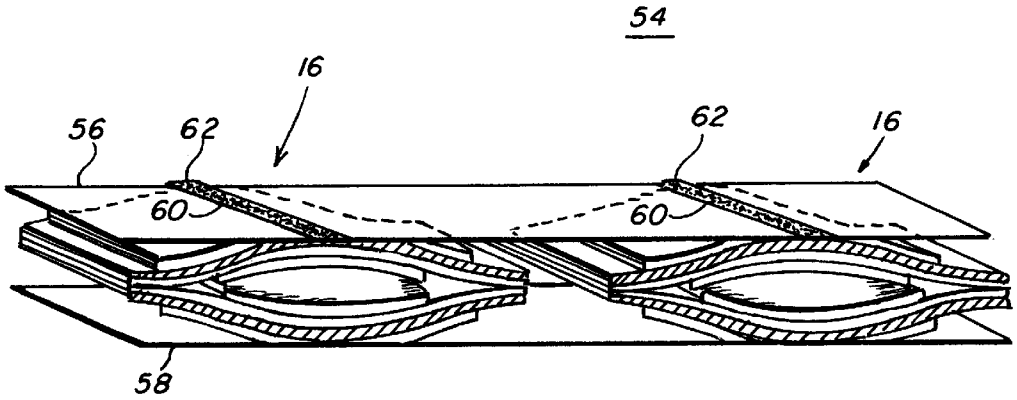
FIG. 4 illustrates one embodiment of an array utilizing a bi-laminate element of the present invention.

FIG. 4 illustrates a group 54 of the acoustic transducers 16 of FIGS. 2 and 3, but only shown in a general manner. The acoustic transducers 16 are brought together with first and second cover sheets 56 and 58 that cover the bi-laminate pairs 18 and 20 and come into contact with the apex of the central portion of each of the bi-laminate pairs 18 and 20 so as to form glue lines 60. An adhesive 62 is placed along glue lines 60 so as to affix the first and second cover sheets 56 and 58 to the bi-laminate pairs 18 and 20 of each of the acoustic transducers 16 at least near the apex of the central portion of each of the acoustic transducers 16. The placement of the cover sheets 56 and 58 reduces the influence in-plane or lateral shrinkage of the active elements of the acoustic transducer 16 and, thus, helps to establish a more uniform piston-type motion of the array 54. The term "piston-type motion" is commonly referred to in the art when describing loud speakers having a movable element, that is, the cone of the loud speaker which serves as the piston-type member. Further, the materials used have flexure modes known in the art which are associated with the operation of the acoustic transducers 16 of the present invention.

A predictive model for the geometry of the acoustic transducers 16 of FIG. 4 can be considered as a simple device suspended in air, with sound radiating in both the forward and backward directions. (In applications in which the acoustic transducer 16 or group 54 of acoustic transducers has a backing or is wall mounted, the analysis is similar, and the displacement Δy and performance levels may be as much as doubled). To a reasonable approximation, the performance of this geometry of the acoustic transducers 16 of the array 54 of FIG. 4, can be predicted using the previous equations (1), (2), and (3) for bi-laminate pairs 18 and 20. The bending element of length $L_a$ of equations (1), (2), and (3) now has the value $L_a/2$ and can be imagined as being fixed at the glue line 60 in FIG. 4. The tip displacement generated by each of the acoustic transducer 16 would then be represented as a thickness displacement of the array 54 of FIG. 4. The curvature of the element, such as bi-laminate pairs 18 and 20, is small and does not significantly affect this estimate of $L_a/2$.

The first and second cover sheets 56 and 58 are preferably of a polymer. The active polymer bi-laminates of pairs 18 and 20 should be sufficiently stiff in length that the driven displacement/force (Δy and F respectively) are not lost in bending. For the active element, that is, the layer thereof composed of the active electro-acoustic material, of each of the bi-laminates pairs 18 and 20, this stiffness condition can be met by insuring that the length $L_a$ of each of the acoustic transducers 16 is smaller than the first flexural mode in the polymer material of the cover sheets 56 and 58, in a manner known in the art. For the cover sheets 56 and 58, an approximate requirement is that the wavelength of the flexural mode in the sheets 56 or 58 be much longer than the spacing of the supports (i.e., the distance between glue lines 60).

At low frequencies the output of the acoustic transducer 16, that is, its flexure or displacement Δy may be limited by the no-load displacement $\Delta y_0$ given by equation 2. At high frequencies it may be limited by the blocked force $F_b$ given by equation 3. Between these two limits the displacement Δy obtained will be related to the force F available through the acceleration:

$$\Delta y = -\frac{a}{\omega^2} = \frac{-F}{m_t\omega^2} \tag{4}$$

where ω is the angular frequency. The total mass to be driven $m_t$ is the mass of the PVDF layers making up the acoustic transducer 16, the mass of the cover sheets 56 and 58, and the equivalent mass of the air. The equivalent mass of the air is related to the radiation impedance (known in the art) and is usually insignificant relative to the other mass terms of equation 4.

To further define the operation of the acoustic transducer 16, the parameters of equation 4 may be combined with the previous relationship between displacement and force (equation 1) and then by eliminating force, we find $$\Delta y = \frac{F_b}{\frac{F_b}{\Delta y_0} - m_t\omega^2} \tag{5}$$

Standard equations are available in textbooks for sound it radiation from sources. Two cases are worth including in a discussion of the practice of the present invention. In one case, if the area of the sound radiator is very large, the corresponding nearfield averaged sound pressure level (SPL) produced can be found from the following relationship:

$$SPL_0 = 20\mathrm{Log}\left|\frac{P_0}{20\mu\mathrm{Pa}}\right| \tag{6}$$

where the term $P_0$ may be expressed by terms known in the art and given as follows:

$$P_0 = \omega\rho_{air}c_{air}\Delta y \tag{7}$$

For small arrays and more distant listening locations, other than the nearfield, the appropriate expression becomes $$SPL = 20\mathrm{Log}\left|\frac{A}{\lambda R}\frac{P_0}{20\mu\mathrm{Pa}}\right| \tag{8}$$

where A is the area of the array, such as the array 54 of FIG. 4, R is the separation distance between the glue lines 60, and λ is the wavelength of the source of the sound radiator.

As an example of the practice of the present invention, consider a unit constructed using commercially available 50 μm PVDF film for each of the layers 22, 28, 32, and 36 of the acoustic transducer 16 and with a 200 μm plastic material for each cover sheet 56 and 58. The bi-laminate pairs 18 and 20 dimensions may be considered to be 2 cm length and 2.8 cm in width, and the bi-laminate pairs 18 and 20 weighing less than one gram. The response of such bi-laminates pairs 18 and 20 may be described with reference to FIG. 5.

Figure 5:
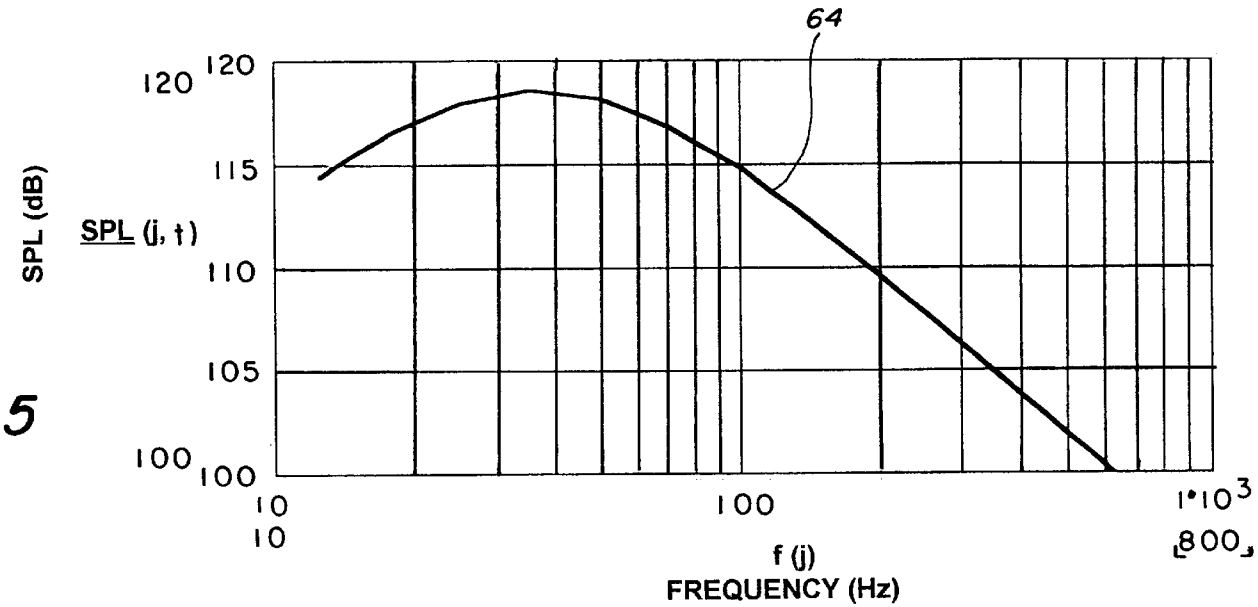
FIG. 5 illustrates a predicted sound pressure level spectrum utilizing a 500 voltage drive signal in the operation of one embodiment of the present invention.

FIG. 5 illustrates a plot 64 representative of the predicted sound pressure level (SPL) spectrum yielded by the acoustic transducer 16 being driven by the application of a 500 volt applied across its electrodes. From FIG. 5 it should be noted that the levels shown therein are associated with nearfield where the acoustic transducer 16 has a rigid back, such as being mounted on a wall.

From FIG. 5, it should be seen that the maximum response of the SPL is near 35 Hz (for the,arrangement shown in FIG. 4) which represents a trade-off between the maximum available displacement and force. At frequencies below this maximum (35 Hz), the performance is limited by the zero-force displacement, which may be further described with reference to FIG. 6 illustrating a plot 66.

Figure 6:
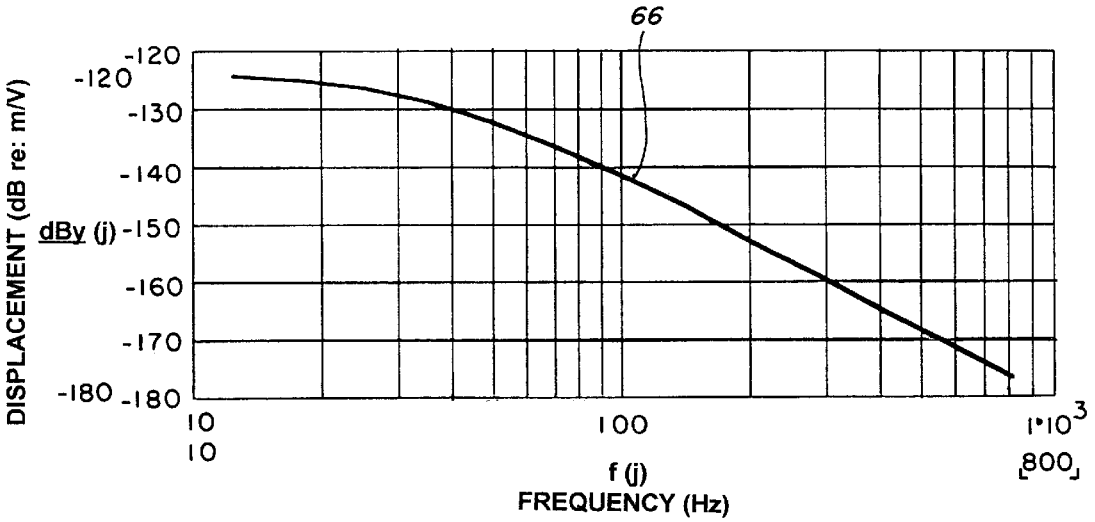
FIG. 6 illustrates a response curve of the predicted displacement of a bi-laminate configuration per volt drive.

As seen in FIG. 6, unless a drive signal is impressed across the electrodes of the acoustic transducer 16, the plot 66 representative of the predicated displacement per volt drive (in decibel units). Further, the plot 66 of FIG. 6 represents that those frequencies above this maximum (35 Hz) are limited by the available (blocked) force. Not shown in the responses of FIGS. 5 and 6, is the influence of flexure of the materials used for the elements of the transducers 16. For the embodiment related to FIG. 4, flexure modes become important above 75 Hz. The effects of some flexure modes are expected to be more noticeable in the frequency region just above this 75 Hz. Near the higher end of the frequency band (i.e., above 300 Hz shown in FIGS. 5 and 6) the high density of the flexural modes may be expected to cause an effective reduction in the acoustic transducers 16 compliance of its elements, such as the PVDF film preferably comprising layers 22, 28, 32, and 36, and increase the deflection over that shown in FIGS. 5 and 6.

In the practice of the present invention a prototype unit was fabricated and consisted of three acoustic transducers 16 arranged in a manner similar to that shown in FIG. 4. Each of the acoustic transducers 16 had approximately the dimensions and construction features previously given for those of FIG. 4. Tho prototype unit carrying the three acoustic transducers 16 was evaluated using a laser Doppler vibrometer (LDV). The displacement results for such a fabrication may be further described with reference to FIG. 7.

Figure 7:
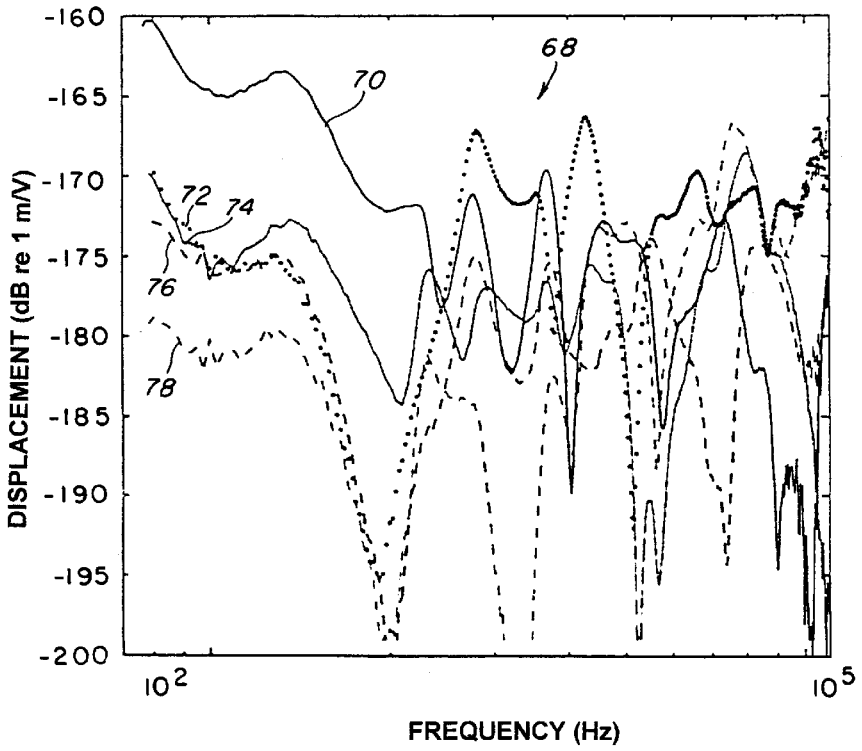
FIG. 7 illustrates a response curve indicative of the displacement of one embodiment of a bi-laminate configuration measured at five different locations thereof.

FIG. 7 illustrates a family of curve 68 comprised of plots 70, 72, 74, 76, and 78, which represent the displacement along five different locations of the array comprised of three acoustic transducers 16. Three of the locations were along the glue lines, such as 62, and the other two locations were the mid-points of the arrangement of the three acoustic transducers 16. FIG. 7 has a X axis given in frequency (Hz) and a Y axis given in displacement $\Delta y$ (decibels relative to one meter per volt (dB re 1 m/v)).

The measured results in FIG. 7 generally confirm the principles of the present invention. More particularly, the average displacement level shown in FIG. 7 is approximately −174 dB re: m/volt, or $2000\times10^{-12}$ m/volt. This is 100 times greater than the value reported for PVDF material operating in its thickness-mode (e.g., its piezoelectric $d_{33}$ constant). Thus, the practice of the present invention realizes a factor of 100 in the improvement in the use of the PVDF material.

At the lower frequencies, the measured displacement of the acoustic transducer 16 is significantly less than that predicted, but higher at increased frequencies. More particularly, a comparison between FIGS. 6 and 7 reveals that the measured displacement shown in FIG. 7 is as much as 30 dB lower than expected at 100 Hz shown in FIG. 6, and nominally 5 dB greater than expected at 1 kHz. The observed lower displacement of FIG. 7 at low frequencies is believed to be due to the limitations of my first attempt at fabrication, and improvements in fabrication and glue selection are contemplated to improve the performance of future prototypes utilizing. the acoustic transducers 16. The increased performance at high frequencies is believed to be due to the lower structural compliance contributed by a high density of structural modes in the cover sheets 56 and 58.

The nearfield SPL of the array having three acoustic transducers 16 could not be readily evaluated due to its small size, however its sound generating capability could be evaluated at a distance. When the very small size of the prototype embodying three acoustic transducers 16 is taken into account, equation (8) predicts the performance thereof which may be further described with reference to FIG. 8.

Figure 8:
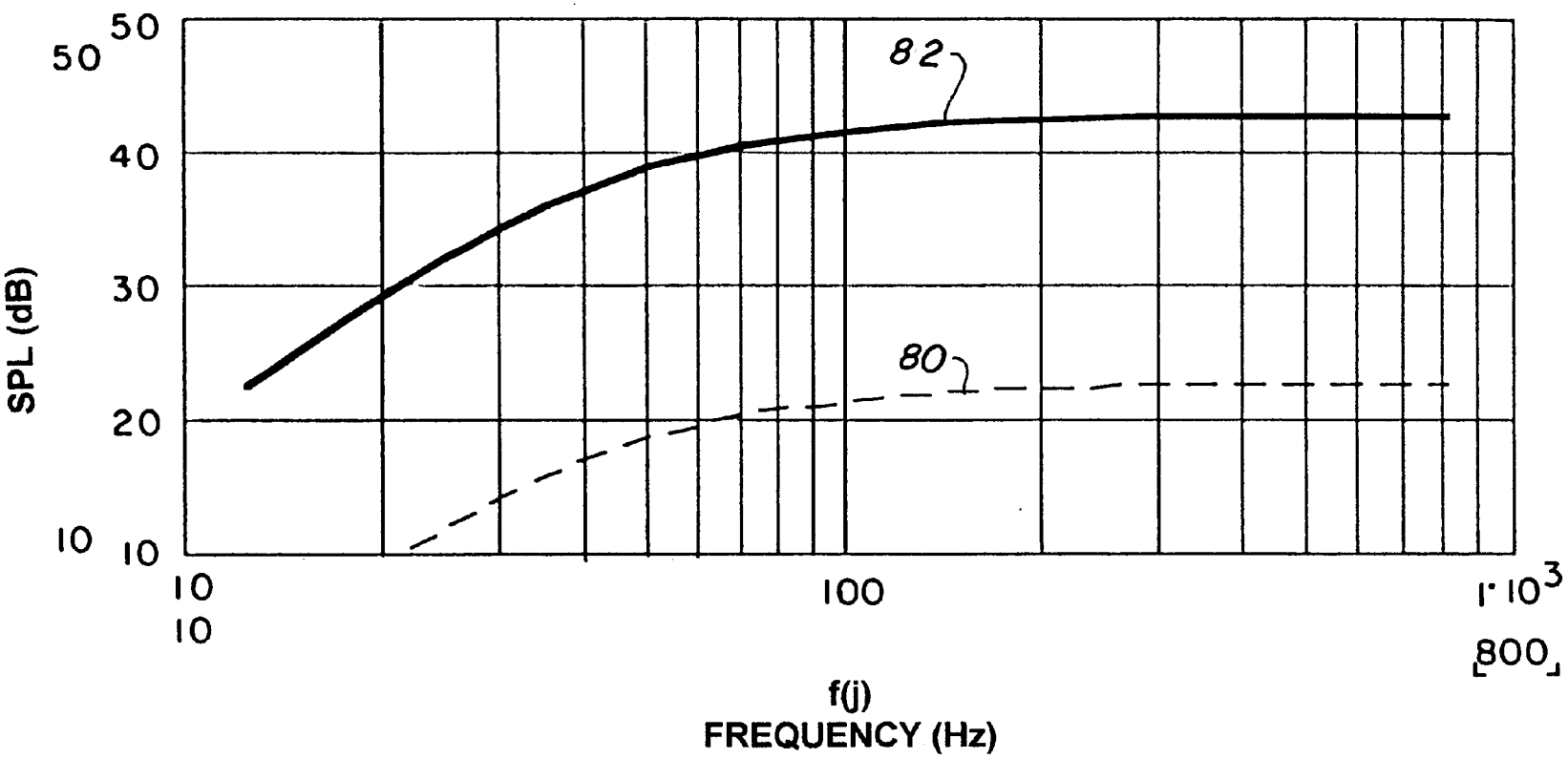
FIG. 8 illustrates a predicted sound pressure level spectrum of another embodiment of the present invention.

FIG. 8 shows two plots 80 and 82, respectively, represented of the predicted SPL at 10 cm distance from the prototype comprised of three acoustic transducers 16 driven at applied voltages of 10 and 100 volts respectively.

The sound output of the relative small prototype unit carrying three acoustic transducers 16 cumulatively weighing less than one gram was tested by electrically connecting the unit to the output of a function generator acting as a source of radiation. With approximately a 10 volt drive level (plot 80) the prototype unit was observed and demonstrated to have a very low, but audible output. The sound level was estimated aurally as 20 dB, and appeared reasonably uniform from 2 to 10 kHz. Below 1 kHz the response became inaudible, which is at least partly due to the reduced sensitivity of human hearing at these low levels and frequencies. This is consistent with the behavior expected from the results shown in FIG. 8. When driven with 100 volts (plot 82), the output was obviously much louder. Unfortunately, this prototype device was damaged before the results at these higher voltages could be quantified by the practice of the present invention.

The principal advantage of this unit, carrying three acoustic transducers 16, is its low mass and wide bandwidth. It is demonstrably capable of producing sound. The practice of the present invention permits optimization for sound generation and control applications. With a sufficiently large device area, it is capable of producing high controllable, sound levels that would be particularly useful in enclosed rooms or spaces. A further embodiment of the present invention may be described with reference to FIG. 9.

Figure 9:
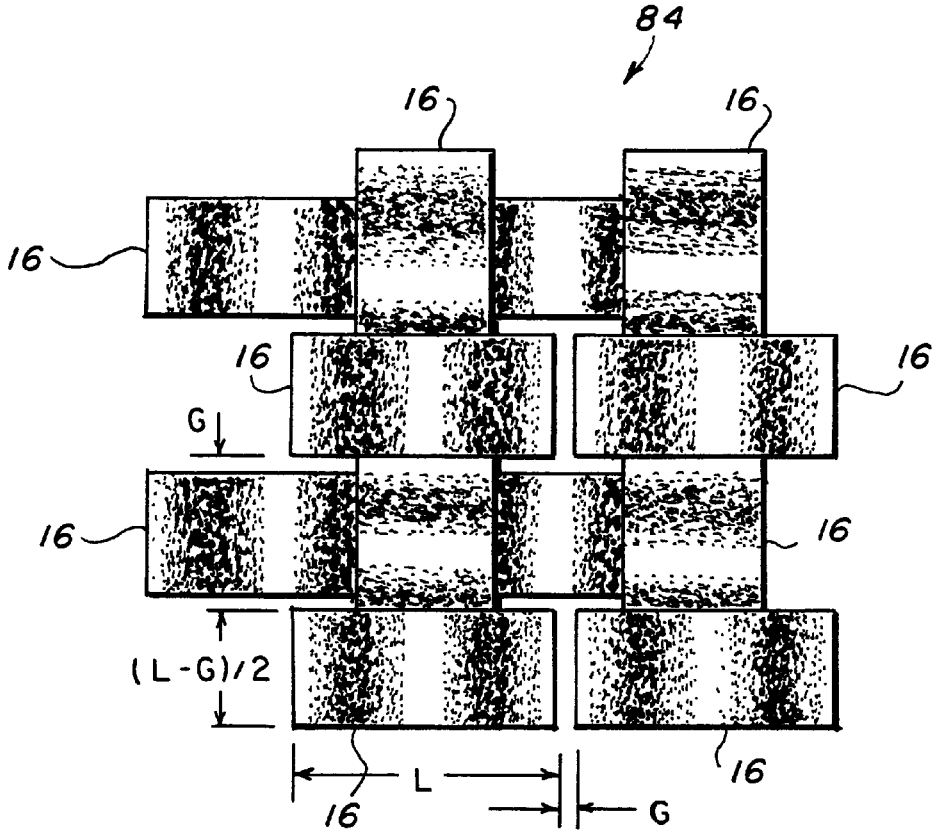
FIG. 9 illustrates a dense packing arrangement comprising one embodiment of the present invention.

FIG. 9 shows a group of acoustic transducers 84 in a woven-type pattern, wherein bi-laminate members of the acoustic transducers 16 are arranged in an interlaced manner relative to each other. These multi-layered laminates can be used to increase the available force to radiated sound. Further, the acoustic transducers 16 of the array 84 can also be stacked to produce a higher output from the acoustic transducer in the low frequencies (displacement limiting) region. The acoustic transducers 16 can easily be overlapped to reduce the distance between support regions. For example, the linear pattern shown in FIG. 4 requires that the cover sheets 56 and 58 expand the difference of $2L_a+G$, where G is the gap or separation distance between the elements. Overlapping acoustic transducers 16 in a woven-type pattern as shown in FIG. 9 reduces the unsupported region to approximately every distance of $L_a+G$. The woven pattern of FIG. 9 is not significantly more difficult to fabricate than the simple linear pattern shown in FIG. 4. However, the useable force of the embodiment of FIG. 9 is somewhat reduced relative to that of FIG. 4.

The embodiment of FIG. 9 is not limited to a rectangular geometry. For example, the embodiment of FIG. 9 can be extended to a disk-type geometry, wherein the outer rims of two bi-laminate disks are glued together. This arrangement has higher stiffness, and hence is more suitable for use with higher forces generating elements or materials.

Figure 10:
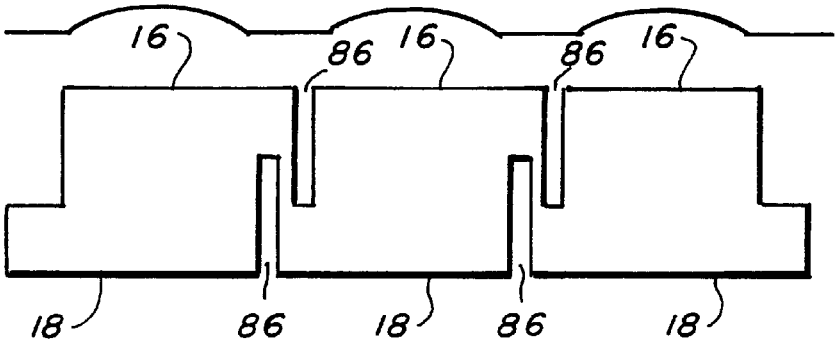
FIG. 10 illustrates an etch and cut pattern associated with one embodiment of the present invention.

The acoustic transducers 16 of FIG. 9 or the other embodiments of the present invention need not be fabricated as separate components. A larger pre-formed sheet of curved transducers can be cut or punched to remove material between elements as generally illustrated in FIG. 10. By partially cutting the regions 86 between elements of the transducers 16, reasonably free motion at the edges 44 is achieved while maintaining electrical continuity between the elements. This approach was used in the prototype discussed above carrying three acoustic transducers 16. Electrode etching may be used on each laminar layer of the elements comprising the transducers 16 to ensure that shorts do not occur at the cuts or regions 86. This approach simplifies the fabrication process since it avoids attaching separate wires to the electrodes of each of the transducers 16.

In the further practice of the present invention, a second prototype acoustic transducer 16 was fabricated having four layers of 25 mm thick Kynar type PVDF copolymer film made available from Material Systems, Inc. Each of the films were 9–12 cm in area and had a silver electrode which was selectively etched to form a desired pattern. The films of the layers were paired and glued together and a curve mold was provided to form the bimorph layers, such as layers 22, 28, or 32 and 36 of FIG. 2. These two bimorph layers, constituting bi-laminate pairs 18 or 20, were then glued to each other as well as to the cover plates 56 and 58. The complete assembly weighed 15 gm, or less than 1 $kg/m_2$. The completed assembly was formed to be three elements wide, with each element running the full width, such as the width W shown in FIG. 2.

The device was adhered to a table and voltage was applied. The displacement generated was measured by a Scanning Laser Doppler Vibrometer. The average surface displacement was measured and the results are shown in FIG. 11, where the units are decibels relative to one meter per volt.

Figure 11:
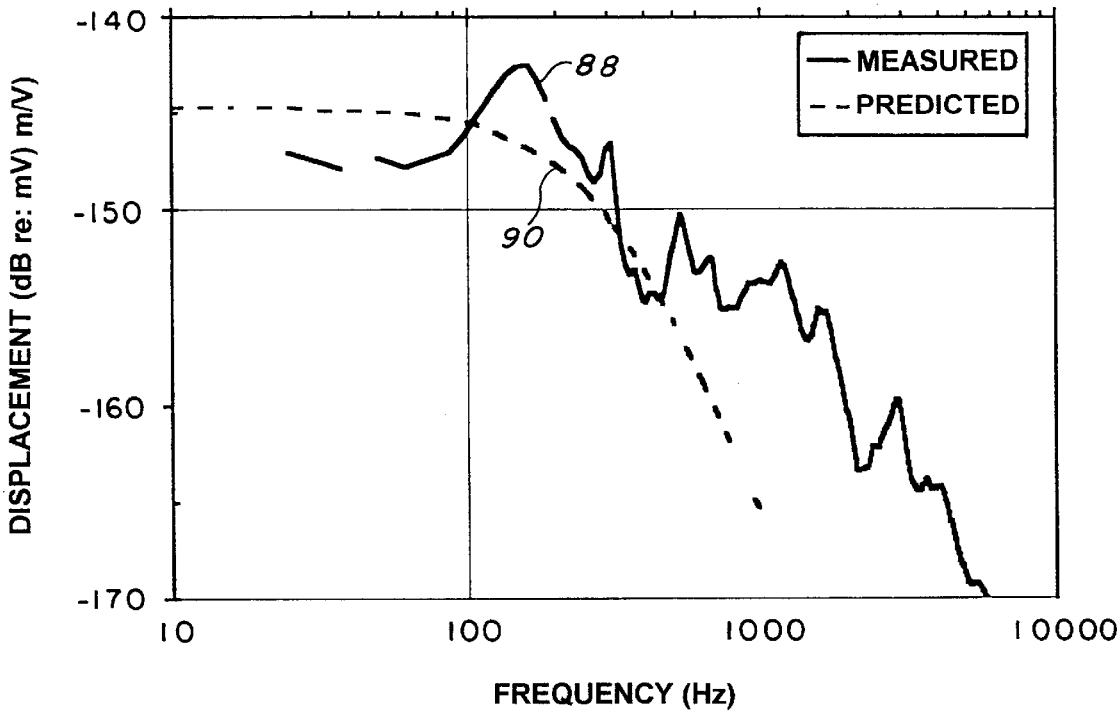
FIG. 11 illustrates a response curve associated with the measured and predicted surface displacement of a bi-laminate configuration of one embodiment of the present invention.

FIG. 11 shows two plots 88 and 90, with 88 representing the measured average surface displacement and 90 representing the predicted average surface displacement.

From FIG. 11, it is seen that the measured surface area displacement below 100 Hz is relatively uniform and in relatively good agreement with the model prediction. As the frequency increases above 100 Hz, both the predicated and the measured data show a progressive decrease in displacement. This is believed to be due to the transition to the region where the displacement is limited by available (blocked) force. Near 230 Hz, the first flexure mode of the cover sheets 56 and 58 becomes apparent. Above 300 Hz the modal complexity increases, with both axes of the cover sheets 56 and 58 disadvantageously contributing. The average surface area measured displacement amplitude in this high frequency region is higher than predicted by the simple model of the predicated quantities used for this testing. The higher values are attributed to the reduced drive impedance (and consequential lower drive force requirement) and the frequency region containing higher modal density. Further details of this embodiment may be described with reference to FIG. 12.

Figure 12:
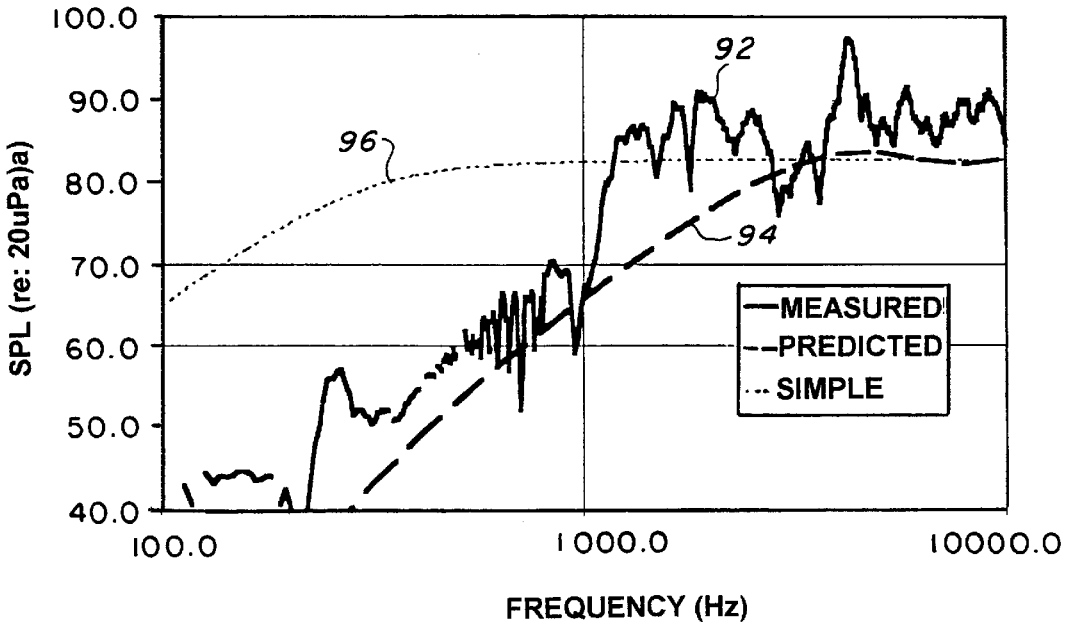
FIG. 12 illustrates measured and predicted sound pressure level responses associated with one embodiment of the present invention.

FIG. 12 illustrates three plots 92, 94, and 96 representative of the measured, predicted, and simple responses of the present invention. More particularly, the plot 94 represents the "predicted"values in a nearfield estimate derived from using the radiation impedance appropriate to the projector area, that is, the surface area of the transducer under test. The plot 96 represents the "simple" values corresponding to the expected performance of the transducer under test having a relatively large surface area. Further, the plot 92 of FIG. 12 represents the sound pressure levels that were measured using a calibrated microphone in a distance farfield of the projector, that is, the transducer under test. The conditions used during the testing were 200 volts applied across the transducer and a 50 cm separation between the support (glue lines) of the transducer.

The sound level produced by the transducer under test was approximately that predicted by surface displacement alone. In general, the produced sound level shown in FIG. 12 is slightly higher than predicted, which was believed to occur due to the low drive impedance needed in regions where there is significant modal behavior of the materials making up the elements of the transducer under test.

Figure 13:
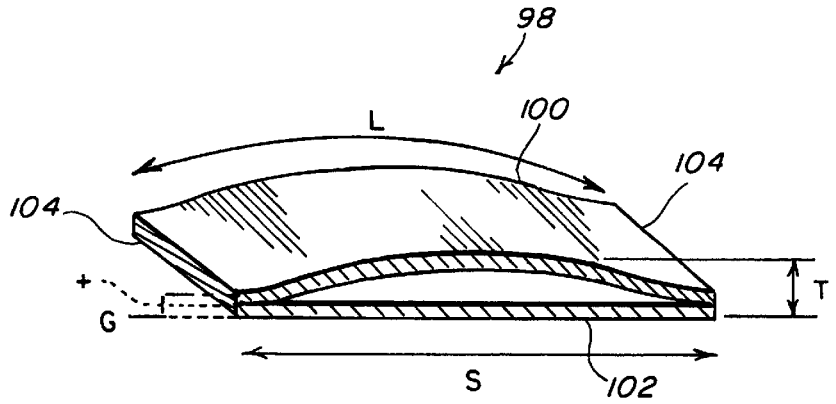
FIG. 13 illustrates still another embodiment of a bi-laminate configuration of the present invention.

A still further embodiment of an acoustic transducer is shown in FIG. 13. FIG. 13 illustrates an acoustic transducer 98 having members 100 and 102, both preferably formed of a PVDF film. The member 100 has a convex central portion, whereas the member 102 is relatively flat and lays under the convex member 100.

This relatively simple two-layer construction is bonded only at the edges 104. The acoustic transducer 98 illustrates the top 100 and bottom 102 members as being arranged with their polarity in a vertical direction. Although not shown, each of the members 100 and 102 carries both an electrode for the ground connection and an electrode for the positive voltage connection in a manner similar to that described with reference to FIG. 3. The outer electrode surface on each member 100 and 102 is grounded, and a voltage is applied to the inner electrode of the members 100 and 102. The positive voltage thus causes the top layer of length "L" to expand, and the bottom of length "S" to contract. The net effect is an increase and curvature of the top layer and a corresponding increase in the separation between the central portion of the layers 100 and 102, labeled an "T."

The displacement and force, related to the acoustic transducer 98, generating ability is approximately given by the expressions $$\Delta y_0 = \frac{2L^2}{3Tt} d_{31} \Delta V \tag{9}$$

$$F_b = \frac{8TW}{3L} Y d_{31} \Delta V \tag{10}$$

where, as previously, t is the film thickness, such as the thickness of layer 100, W is the width, and Y is the Young's modulus of the material making up the layers 100 and 102. These equations are only provided to illustrate the operation of the transducer 98, since edge boundary constraints and other fabrication variable may influence the performance observed.

Figure 14:
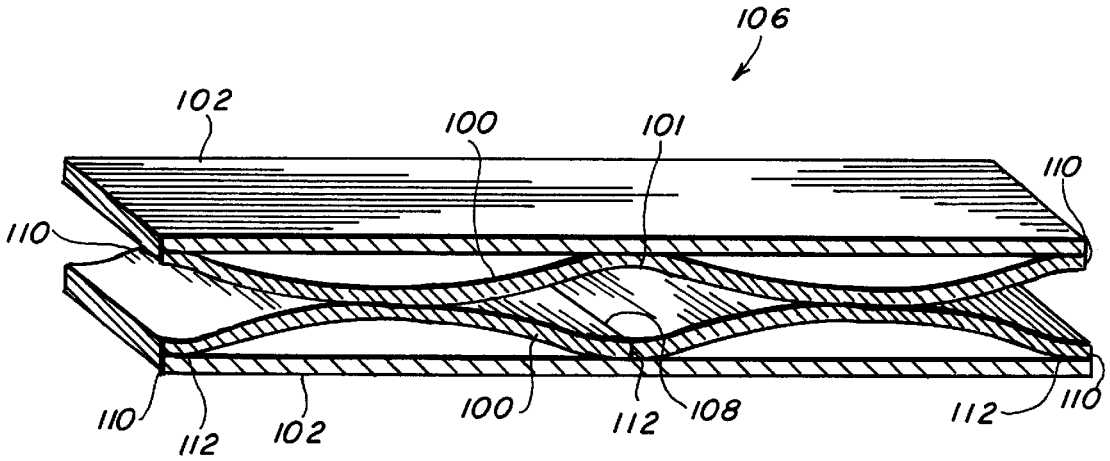
FIG. 14 illustrates a still further embodiment of a bi-laminate configuration of the present invention.

A further embodiment of the present invention may be further described with reference to FIG. 14 illustrating a acoustic transducer 106. The transducer 106 comprises first and second members 100 and 102, described with reference to FIG. 13, that extend along the elongated length $L_a$, such as that shown in FIG. 3. The members 100 are arranged so that the apex of each of their central portion mate with each other as shown in FIG. 14. The members 102 are selected to have a length to provide a flat surface for a back-to-back arrangement of the members 100, as shown in FIG. 14. The opposite distal ends of the members 100 are fixed to the members 102 at glue lines 108 and edges 110 by a suitable adhesive 112 as shown in FIG. 14. The first members 100 have central portions along the elongate length and disposed between their distal ends. The central portions of the members 100 are arranged so as to merge toward each other in a direction transverse to the elongated length and effective to permit vibration of the first and second members 100 and 102 with respect to one another.

It should now be appreciated that the practice of the present invention provides for various embodiments for low-mass sound generators each having a wide frequency bandwidth.

Although a few preferred embodiments of the present invention have been shown and described, it would be appreciated that those skilled in the art that changes may be made in these embodiments without departing from the principles and spirit of the invention the scope of which is defined in the claims and their equivalence.

What I claim is:

1. An acoustic transducer comprising:

a pair of members, each of said members comprising at least one layer and having distal opposite ends and a central portion therebetween, said at least one layer of each of said members being of active electro-acoustic material, each of said members having inner and outer surfaces with a first electrode affixed to each outer surface of each of said members and a second electrode affixed to each inner surface of each of said members; wherein each of said members extends along an elongate length, each of said members being affixed to one another at their respective distal opposite ends along said length and wherein said members thereby define a space therebetween having a volume; and wherein said central portion of at least one of said members is convex, said central portion of each of said members defines a space therebetween having a volume, and at least one of said first and second electrodes are confined to urge upon activation at least one of said members to move with respect to the other of said members and thereby change volume of said space between said members during vibration of said at least one activated member.

2. The acoustic transducer according to claim 1, wherein each of said members is affixed to the other member by an adhesive.

3. The acoustic transducer according to claim 2, wherein each of said first and second electrodes is free of contact with said adhesive.

4. The acoustic transducer according to claim 1, wherein each of said first electrodes is connected to a ground potential.

5. The acoustic transducer according to claim 1, wherein each of said second electrodes is connected to a positive voltage potential.

6. The acoustic transducer according to claim 1, wherein said at least one of said members having said convex central portion comprises a bilaminate including a first bilaminate member thereof having a convex central portion and a second bilaminate member thereof being relatively flat and laying under said first convex bilaminate member.

7. An acoustic transducer comprising:

first and second bi-laminate members comprising at least two layers and each of said first and second bi-laminate members having distal ends and a central portion therebetween and being of an active electro-acoustic material and extending along an elongate length, each of said first and second bi-laminate members having inner and outer surfaces with a first electrode affixed to each outer surface of each said first and second bi-laminate members and a second electrode affixed to each inner surface of each of said first and second bi-laminate members;

said central portion of at least one of said first and second bi-laminate members being convex, said central portions of each of said first and second bi-laminate members defining a space therebetween having a volume, and wherein at least one of said first and second electrodes are configured to urge upon activation at least one of said members to move with respect to the other of said members and thereby change said volume of said space between said members during vibration of said at least one activated member, and a first adhesive for affixing said first and second bi-laminate members to each other at least near said distal ends of said first bi-laminate member.

8. The acoustic transducer according to claim 7, wherein each of said first electrodes is connected to a ground potential.

9. The acoustic transducer according to claim 7, wherein each of said second electrodes is connected to a positive voltage potential.

* * * * *